US005106086A

United States Patent [19]

Acosta

[11] Patent Number: 5,106,086

[45] Date of Patent: Apr. 21, 1992

[54] VIBRATION DAMPENER FOR RACKETS

[76] Inventor: Richard J. Acosta, 12131 E. Ruchel St., Norwalk, Calif. 90650

[21] Appl. No.: 780,894

[22] Filed: Oct. 23, 1991

[51] Int. Cl.[5] ..... A63B 51/10

[52] U.S. Cl. ..... 273/73 R

[58] Field of Search ..... 273/73 R, 73 A, 73 C, 273/73 D, 73 E

[56] References Cited

U.S. PATENT DOCUMENTS

| | | | |
|---|---|---|---|
| 3,874,666 | 4/1975 | Ross | 273/73 R |
| 4,180,265 | 12/1979 | Staufer | 273/73 D |
| 4,575,083 | 3/1986 | Adam | 273/73 D |
| 4,609,194 | 9/1986 | Krent et al. | 273/73 D |
| 4,732,383 | 3/1988 | Ferrari et al. | 273/73 D |
| 4,761,007 | 8/1988 | Boschian | 273/73 D |
| 4,875,679 | 10/1989 | Movilliat et al. | 273/73 R |
| 4,909,509 | 3/1990 | Boschien | 273/73 R X |
| 4,927,143 | 5/1990 | Hillock | 273/73 D |
| 5,022,651 | 6/1991 | Barone | 273/73 R X |

FOREIGN PATENT DOCUMENTS

| | | | |
|---|---|---|---|
| 1398833 | 4/1965 | France | 273/73 D |
| 2630019 | 10/1989 | France | 273/73 D |
| 2135588 | 9/1984 | United Kingdom | 273/73 D |

OTHER PUBLICATIONS

"Tennis Elbow Rounds the Bend", *Tennis Tech*, Aug., 1987, pp. 18–19.

*Primary Examiner*—William H. Grieb
*Assistant Examiner*—William E. Stoll

[57] ABSTRACT

A vibration dampening device is of two-piece construction with each piece having an outer plastic backing sheet for a layer of vibration dampening foam material secured to the inner surface of the backing sheet. A layer of pressure sensitive adhesive material is disposed on the inner surface of the vibration dampening foam material, such adhesive material being initially covered by a protective tape. The protective tape is pulled off of the adhesive material of each of such pieces and the two pieces aligned vertically over adjacent strings on either side of the racquet. Thereafter, the two pieces are pressed tightly towards each other to cause the pressure-sensitive adhesive material to adhere together and thereby anchor the two pieces as an integral unit upon the strings.

2 Claims, 1 Drawing Sheet

VIBRATION DAMPENER FOR RACKETS

BACKGROUND OF THE INVENTION

1. Field of the Invention

The present invention relates generally to vibration dampening devices and more particularly to vibration dampening devices for hand held sporting rackets having a strung striking surface, such as tennis rackets.

2. Background of the Invention

Most strung hand held sporting rackets have a striking surface or face formed of two intersecting sets of parallel strings suspended by and enclosed by an oval frame. One set of strings extends generally parallel to the handle of the racket and may be called the longitudinal strings, while the other set of strings extends generally transversely of the handle and may be called the transverse strings. In such rackets, vibrations are produced in the racket face when a ball is struck. The vibrations are most severe when the ball does not strike the racket face in the center thereof, but strikes it at a distance spaced from the center. Initially, rather large vibration is detected in the racket face and this initial vibration is followed by a series of smaller vibrations which eventually die out with time. Such vibrations are transmitted generally along the transverse and longitudinal strings of the racket, to the frame surrounding and holding the strings, and eventually down the racket handle to the hand and then the arm of the player. It has been shown that a player who has been subject to extensive periods of racket-induced vibrations can sustain "tennis elbow" injury to his or her arm. It is therefore desirable to reduce such vibrations both for the comfort and protection of the player.

Devices for dampening the vibrations in a tennis racket are well known. A typical device is shown in U.S. Pat. Nos. 4,180,265; 4,609,194 and 4,776,590. Such dampeners couple together and interlock racquet strings. Devices as shown in prior patents have not been entirely successful, since they are sometimes difficult to attach to the racket face, and can interfere with the flight of the ball if struck by the ball. Also, such devices often fall off the racket strings during play.

Other devices which interconnect the strings of a racket include U.S. Pat. Nos.: 4,368,886; 3,921,979; 4,078,796; 4,168,065; and 1,682,199; and International Patent Institute 81/03431 which discloses a pair of pads secured together on the strings by screws, bolts or the like.

SUMMARY OF THE INVENTION

It is an object of this invention to provide a vibration dampening device for tennis rackets and the like having a strung striking surface which performs in a manner superior to prior art vibration dampening devices.

It is a further object of this invention to provide a vibration-dampening device for strung sporting rackets which can be easily inserted into and removed from the racket face.

It is another object of this invention to provide a vibration-dampening device for strung sporting rackets which does not interfere with the flight of the ball, and which can be placed in any position on the racket face to provide optimal dampening of vibrations.

In accordance with the above-described objects, a vibration-dampening device is provided which operates by mechanically isolating a plurality of strings to produce optimal vibration dampening characteristics.

A Vibration dampening device embodying the present invention is of two-piece construction with each piece having an outer plastic backing sheet for a layer of vibration dampening foam material secured to the inner surface of the backing sheet. A layer of pressure sensitive adhesive material is disposed on the inner surface of the vibration dampening foam material, such adhesive material being initially covered by a protective tape. The protective tape is pulled off of the adhesive material of each of such pieces and the two pieces aligned vertically over adjacent strings on either side of the racquet. Thereafter, the two pieces are pressed tightly towards each other to cause the pressure-sensitive adhesive material to adhere together and thereby anchor the two pieces as an integral unit upon the strings.

DETAILED DESCRIPTION OF THE PREFERRED EMBODIMENT

Figure 1:
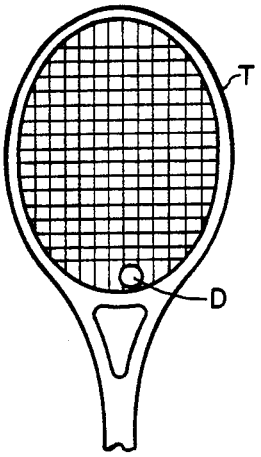
FIG. 1 is a top plan view of a tennis racquet provided with a two-piece vibration dampener embodying the present invention.
Figure 2:
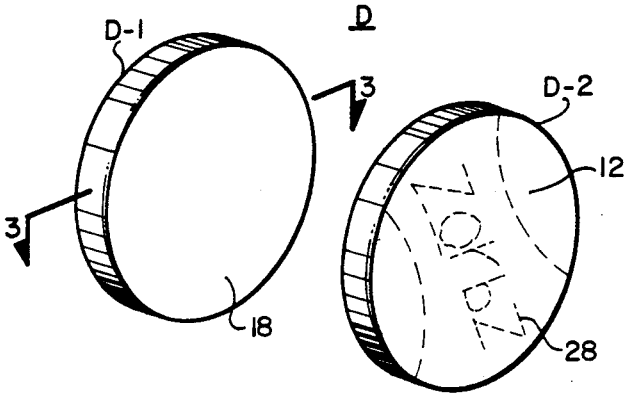
FIG. 2 is a perspective view of the two pieces of said vibration dampener.

Referring to FIG. 1 of the drawings, a tennis racquet T is provided with a vibration dampener D embodying the present invention. The vibration dampener D is shown affixed to the strings of the tennis racquet in a manner to be described hereinafter. Referring to FIG. 2, there is shown a vibration dampener D embodying the present invention. Vibration dampener D consists of two annular pieces D1 and D2 which are mirror images of one another having the same dimensions.

Figure 3:
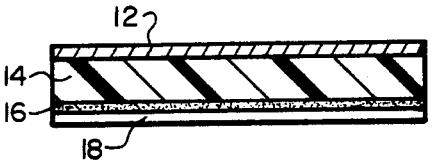
FIG. 3 is a vertical sectional view taken in enlarged scale along line 3—3 of FIG. 2.

Turning now to FIG. 3, the construction of each of the pieces D1 and D2 include an outer backing sheet 12 formed of a tough flexible synthetic plastic material as for example, a thin PVC material. A layer of vibration dampening synthetic plastic foam material 14 has its outer surface tightly adhered to the inner surface of the backing sheet. Such foam material may be made of a suitable expanded synthetic plastic. A layer of a pressure-sensitive adhesive material 16 is disposed on the inner surface of the vibration dampening foam material. The adhesive material may be a suitable acrylic. The inner surface of the adhesive 16 is initially covered by a synthetic plastic protective tape 18 which is releasably stuck upon the inner surface of the pressure-sensitive material. A suitable transfer tape is marketed by 3M as Product No. F9752PC. It has been found that 3M markets a double sided adhesive industrial tape Number 4955 or 4959 which can be utilized as the aforementioned foam 14 and adhesive 16. It has also been found advantageous to adhere a sheet of stiff but bendable material such as Mylar, (not shown) to the inner surface of the backing sheet 12 to resist cracking of the backing sheet while permitting it to bend.

Figure 4:
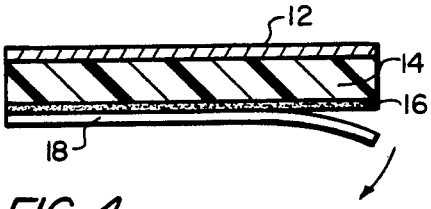
FIG. 4 is a view similar to FIG. 3 but showing how a protective tape is removed from the pressure-sensitive material of the vibration dampener.
Figure 5:
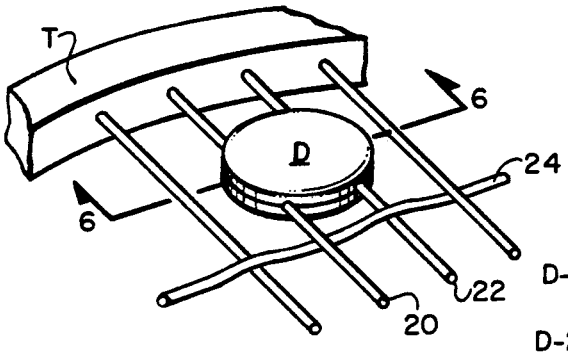
FIG. 5 is a fragmentary perspective view showing said vibration dampener attached to the strings of a tennis racquet.
Figure 6:
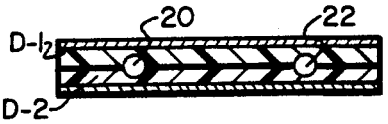
FIG. 6 is a vertical sectional view taken in enlarged scale along line 6—6 of FIG. 5.

Referring now to FIGS. 4, 5 and 6, in order to apply the afore mentioned vibration dampener D to the strings of racquet 10, the protective tapes 18 are peeled off their respective layers of pressure sensitive adhesive material, as indicated in FIG. 4. With the protective tapes of both pieces D1 and D2 removed, the two pieces are aligned vertically over adjacent strings on either side of the racquet face. Thereafter, the two pieces are pressed tightly towards each other to cause the pressure-sensitive adhesive material to adhere together and thereby anchor the two pieces as an integral vibration dampening unit upon the strings. It has been found particularly desirable to position the vibration dampener over the middle two longitudinal strings 20 and 22 below the first transverse string 24. The vibration dampener may be otherwise positioned with respect to the racquet strings, however, It should also be noted that although the vibration dampener is shown as being of annular configuration, it may assume other configurations, as for example, the configuration of a miniature tennis racquet. Another major advantage of vibration dampeners embodying the present invention is that the outer surface of the backing sheet 12 can be provided with an aesthetically pleasing appearance utilizing various bright colors. Moreover, advertising indicia 28, such as advertising, may be incorporated in such coloring. The coloring may employee holographics. Once the two pieces of the vibration dampener have been adhered together, they will firmly resist separation from one another and hence from the racquet strings. The aforedescribed vibration dampener will not interfere with the flight of a ball which engages same.

Various modifications and changes may be made with respect to the foregoing detailed description without departing from the spirit of the invention.

I claim:

1. A two-piece vibration dampener for dampening vibrations in the striking surface of a racquet having strings, each piece of such dampener being a mirror image of the other and comprising:

an outer backing sheet of tough flexible synthetic plastic;

a layer of vibration dampening foam material having its outer surface bonded to the inner surface of said backing sheet;

a layer of pressure-sensitive adhesive material disposed on the inner surface of said vibration dampening foam material;

a protective tape releasably stuck upon the inner surface of said pressure-sensitive adhesive material; and with the protective tapes being peeled off their respective layers of pressure-sensitive adhesive material and the two pieces aligned vertically over adjacent strings on either side of the face of the racquet, whereafter the two pieces are pressed tightly towards each other to cause the pressure-sensitive adhesive material of the two pieces to adhere together and thereby anchor the two pieces as an integral vibration dampening unit upon the strings.

2. A vibration dampener as set forth in claim 1 wherein the outer surface of the outer backing sheets bear indicia.

* * * * *